US006202771B1

(12) United States Patent
Scott et al.

(10) Patent No.: US 6,202,771 B1
(45) **Date of Patent: *Mar. 20, 2001**

(54) CUTTING ELEMENT WITH CONTROLLED SUPERABRASIVE CONTACT AREA, DRILL BITS SO EQUIPPED

(75) Inventors: Danny E. Scott, Montgomery, TX (US); Redd H. Smith, Salt Lake City, UT (US); Ralph M. Horton, Murray, UT (US); Arthur A. Chaves, Sandy, UT (US)

(73) Assignee: Baker Hughes Incorporated, Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/935,931

(22) Filed: Sep. 23, 1997

(51) Int. Cl.[7] ..... E21B 10/46
(52) U.S. Cl. ..... 175/432; 175/430; 175/431
(58) Field of Search ..... 175/432, 431, 175/430

(56) References Cited

U.S. PATENT DOCUMENTS

| | | | | |
|---|---|---|---|---|
| 4,861,350 | | 8/1989 | Phaal et al. . | |
| 4,926,950 | * | 5/1990 | Zijsling | 175/39 |
| 4,972,637 | | 11/1990 | Dyer . | |
| 5,007,207 | | 4/1991 | Phaal . | |
| 5,054,246 | | 10/1991 | Phaal et al. . | |
| 5,120,327 | | 6/1992 | Dennis . | |
| 5,217,081 | | 6/1993 | Waldenström et al. . | |
| 5,238,074 | | 8/1993 | Tibbitts et al. . | |
| 5,355,969 | | 10/1994 | Hardy et al. . | |
| 5,435,403 | | 7/1995 | Tibbitts . | |
| 5,437,343 | | 8/1995 | Cooley et al. . | |
| 5,447,208 | | 9/1995 | Lund et al. . | |
| 5,484,330 | | 1/1996 | Flood et al. . | |
| 5,486,137 | | 1/1996 | Flood et al. . | |
| 5,494,477 | | 2/1996 | Flood et al. . | |
| 5,566,779 | | 10/1996 | Dennis . | |
| 5,590,729 | | 1/1997 | Cooley et al. . | |
| 5,605,198 | | 2/1997 | Tibbitts et al. . | |
| 5,605,199 | | 2/1997 | Newton . | |
| 5,645,617 | | 7/1997 | Frushour . | |
| 5,647,449 | | 7/1997 | Dennis . | |
| 5,653,300 | | 8/1997 | Lund et al. . | |
| 5,709,279 | | 1/1998 | Dennis . | |
| 5,711,702 | | 1/1998 | Devlin . | |
| 5,788,001 | * | 8/1998 | Matthias et al. | 175/432 |

FOREIGN PATENT DOCUMENTS 0 687 797 A1 12/1995 (EP) .

* cited by examiner

*Primary Examiner*—Hoang Dang
(74) *Attorney, Agent, or Firm*—Trask Britt

(57) ABSTRACT

Cutting elements providing a relatively constant superabrasive area in contact with the formation responsive to weight on bit during a substantial portion of the useful life of a circular cutting face cutting element or other cutting element exhibiting a non-linear cutting edge, for example, from about 5% diametrical wear to in excess of about 30% diametrical wear in the case of a circular cutting element, measured across the cutting face. The superabrasive table of the cutting element is configured, internally, externally, or both, to vary in depth radially and laterally, as required, so that an increase in width of the contact or wear flat area with the formation and the variation in table depth as the cutting element wears, are substantially offsetting. The rate of penetration of a drill bit so equipped may thus be maintained at a desirable magnitude without a substantial increase in weight on bit as the cutting element wears, since the superabrasive contact area is maintained relatively constant.

67 Claims, 6 Drawing Sheets

CUTTING ELEMENT WITH CONTROLLED SUPERABRASIVE CONTACT AREA, DRILL BITS SO EQUIPPED

BACKGROUND OF THE INVENTION

1. Field of the Invention

The present invention relates generally to cutting elements for rotary drill bits for subterranean drilling, and more specifically to cutting elements providing a controlled superabrasive contact area during a predominant portion of the useful life of the cutting element, as well as bits so equipped and methods of drilling therewith.

2. State of the Art

Rotary bits are the predominant type of drill bits employed for subterranean drilling to oil, gas, geothermal and other formations. Of the types of rotary bits employed, so-called fixed cutter or "drag" bits have garnered an ever-increasing market share over the past few decades. This market share increase is attributable to a number of factors, but significant ones must be acknowledged as the wide availability and performance of superabrasive cutting elements.

Superabrasive cutting elements in their present state typically take the form of a polycrystalline diamond compact (PDC) layer or "table" formed onto a supporting substrate, typically of a cemented or sintered tungsten carbide (WC), in a press under ultra-high pressure and temperature conditions. Other superabrasive materials are known, including thermally stable PDCs, diamond films, and cubic boron nitride compacts. The present invention has utility with cutting elements employing any superabrasive material.

Several physical configurations of superabrasive tables for cutting elements are known, including square, "tombstone" shape, and triangular. However, the most common shape is circular, backed by a circular substrate of like size. These circular superabrasive tables are usually formed substantially to size in a press, but may be cut from larger, disc-shaped blanks. The other referenced shapes are generally required to be cut from a larger, disc-shaped blank, thus generating a large volume of scrap, reducing yield during fabrication and increasing fabrication costs.

As can be seen in FIGS. 1 and 2 of the drawings, state-of-the-art, disk-shaped cutting element 10 includes a circular, PDC superabrasive table 12 of substantially constant depth mounted to a disk-shaped WC substrate 14. Superabrasive table 12 includes a cutting face 16, a cutting edge 18 at the periphery of cutting face 16, and a side 20 to the rear of cutting edge 18 (taken in the direction of cutting element travel, cutting face-first). Cutting element 10 would typically be oriented on a drill bit with at least a nominal negative backrake so that cutting face 16 "leans" away from the formation being drilled. As the cutting edge 18 and side 20 of superabrasive table 12 of cutting element 10 first contact the formation under application of weight on bit (WOB) at location 22 of cutting edge 18, it can be seen that the superabrasive contact area is extremely small in both longitudinal depth or thickness as well as width, in part due to the aforementioned backrake. Thus, for a given WOB, the responsive loading per unit surface area at the side 20 of superabrasive table 12 contacting the formation being drilled is extremely high.

Due to the circular shape of the superabrasive table 12, however, as the cutting element 10 begins to wear and a so-called "wear flat" forms at one side of cutting face 16, superabrasive table 12 and the WC substrate 14 therebehind, the contact area of the superabrasive material under WOB, or so-called Normal force applied along the axis of the drill string to which the bit is secured, increases markedly in width and therefore in total area. The increasing contact area consequently requires an increase in WOB to maintain cutting element loading in terms of load per superabrasive unit surface area in contact with the formation to continue an acceptable rate of penetration (ROP). However, as WOB increases, so does wear on the superabrasive table, as well as the likelihood of spalling and fracture damage thereto. In addition, the requirement to increase WOB may undesirably affect drilling performance in terms of reducing steerability of a bit, as well as precipitate stalling of a downhole motor when the torque required to rotate under excessive WOB is exceeded, with consequential loss of tool face orientation. As can readily be visualized by looking at the relative contact area widths at location 22, location 24 (as the cutting element is about 20% in diameter worn) and location 26 (as cutting element 10 is about 40% in diameter worn and typically approaching, if not well past, the end of its useful life), the superabrasive contact area may increase by more than an order of magnitude from the time a cutting element first engages a formation until the end of its useful life, thus requiring an attendant increase in WOB to maintain ROP in a given formation.

This undesirable increase in superabrasive contact area is present in conventional PDC cutting elements bearing constant-thickness superabrasive tables of about 0.030 inch thickness. However, as cutting elements bearing tables of greater thicknesses are developed, for example 0.070 inch and 0.100 inch uniform-thickness tables, the contact area increase is exacerbated. The increase in wear flat area for such PDC cutting elements of 13 mm (0.529 inch) diameter is illustrated in FIG. 9, wherein superabrasive contact area versus percentage of cutting face diametric wear is shown respectively by lines A, B and C for cutting elements of 0.030, 0.070 and 0.100 inch superabrasive table thickness. For each of the 0.030 inch, 0.070 inch and 0.100 inch thickness tables, the contact area more than doubles between 5% and 30% diametric wear of the superabrasive table. More significantly, for the 0.070 inch and 0.100 inch thickness superabrasive tables, contact area quickly increases in absolute terms to in excess of 0.02 square inch (the maximum superabrasive contact area for a 13 mm, 0.030 inch thick table PDC cutting element), thus necessitating substantial and undesirable WOB increases extremely early in the life of the cutting element in order to maintain the load per unit surface area of superabrasive material contacting the formation. While use of a square or tombstone-shaped cutting face, would obviously provide a relatively constant superabrasive contact area, as noted above such configurations are undesirable for other reasons. Consequently, there is a need in the art for a cutting element exhibiting a circular cutting face and superabrasive table, the term "circular" as used herein including a segment of a circle a segment or which otherwise exhibits an arcuate or nonlinear cutting edge, which provides a relatively constant superabrasive contact area during a large portion of the useful life of the cutting element.

BRIEF SUMMARY OF THE INVENTION

In contrast to the circular or disk-shaped cutting elements comprising the state of the art, the cutting elements of the invention are configured with superabrasive tables having configurations such that the surface area of superabrasive material in contact with a formation being cut by the cutting element responsive to WOB quickly reaches a relatively stable value, which value remains relatively constant over a substantial portion of the useful life of the cutting element, for example, from about 5% to about 30% wear across the diameter of the cutting face. The present invention provides this relatively stable value of a relatively small magnitude, for example, from about 0.018 to about 0.021 square inch for a 13 mm (0.529 inch) diameter cutting element.

One embodiment of the cutting element of the present invention is configured with a planar cutting face and a non-planar interface between the superabrasive table and the supporting substrate, wherein at least one radially-oriented, substantially isosceles triangular projection of increased superabrasive table thickness lies adjacent the periphery of the superabrasive table with the triangle base oriented toward the formation. The superabrasive projection gradually decreases in thickness and width from a location adjacent the cutting edge at the periphery of the as-formed, unworn superabrasive table toward the center of the cutting element. During drilling, the decrease in thickness and width of the superabrasive projection as the cutting element wears is substantially offset by an increase in width of contact with the formation of the superabrasive table as a whole, attributable to the increasing lateral contact span of the thinner portions of the table laterally flanking the projection as the cutting element wears during use. In actual practice, it may be desirable to fabricate such a cutting element with, for example, four such triangular projections at 90° rotational intervals, so as to maintain symmetrical stress patterns at the superabrasive table-to-substrate interface. Such an embodiment may employ projections which immediately commence a decrease in depth from the cutting face periphery, or may maintain an initial constant depth or even increase in depth for a measurable distance from the table periphery, to provide a robust superabrasive mass to effect and sustain the initial contact with the formation until the wear flat is well-established.

Another embodiment of the invention features a cutting element employing a superabrasive table which features a thicker portion of constant width lying along a radius of the cutting element, the table decreasing non-linearly in thickness toward the center of the cutting element in proportion to the increase in contact area width of the superabrasive table, so as to maintain a substantially constant superabrasive contact area for a significant portion of the cutting element life.

It is contemplated that cutting elements according to the invention having superabrasive tables employing superabrasive projections or thickness increases leading or projecting from the cutting faces of the tables may be employed. For example, a triangular or other shape projection may lie on the cutting face, or the cutting face may be of a convex configuration, with the increased superabrasive depth exhibited as a domed, diametrically-extending ridge.

It is further contemplated that cutting elements according to the present invention may be configured with cutting tables of varying depth, wherein the depth variances are manifested both internally (at the substrate interface) and externally (as a projection from the cutting face, or non-planar cutting face), or both.

It is also contemplated that the invention may be embodied in the form of a half-circular, one-third circular, or other circular fraction cutting element having an internal or external superabrasive table projection, or both, of appropriately varying depth and/or width, as the case may be, extending from an arcuate cutting edge at a periphery of the table toward a center point from which the radius defining the cutting edge extends. The invention may also be employed with cutting elements exhibiting cutting edges of other than constant radius, such as ellipsoidal cutting edges, to compensate for increases in superabrasive contact area.

Finally, it may be recognized that extreme variations in backrake of a cutting element when mounted to a drill bit may necessitate some adjustment in the configuration in terms of variations in thickness and width of the deeper portions of the superabrasive table to ensure a substantially constant superabrasive contact area responsive to WOB, since a highly backraked cutting element will present a larger contact area to the formation than a slightly backraked one and the contact areas of cutting elements bearing particularly thick superabrasive tables will be particularly affected by large backrakes.

The invention also includes methods of drilling with bits equipped with cutting elements of the invention, wherein a relatively constant superabrasive contact area with the formation is maintained, and a substantially constant ROP may be maintained throughout a substantial portion of cutting element life under a relatively constant applied WOB.

DETAILED DESCRIPTION OF THE INVENTION

Figure 1:
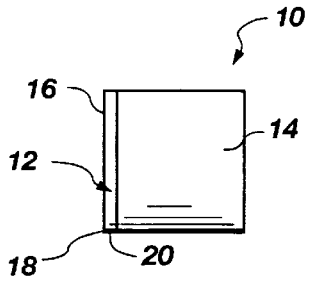
Fig. 1 (PRIOR ART)
FIGS. 1 and 2 comprise, respectively, side and frontal views of a prior art, circular, superabrasive cutting element.
Figure 2:
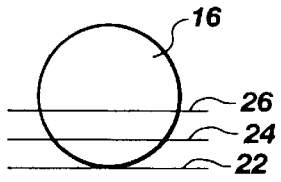
Fig. 2 (PRIOR ART)
Figure 3A:
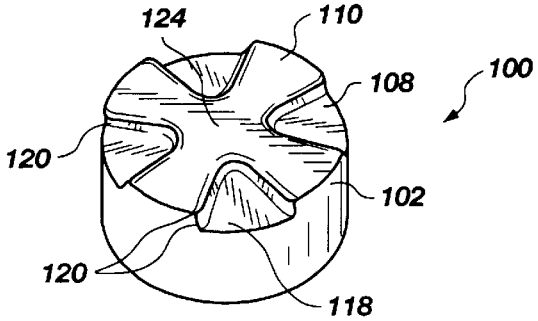
FIGS. 3A, 3B and 3C comprise, respectively, perspective, frontal and side sectional views of a substrate for a first embodiment of the invention.
Figure 3B:
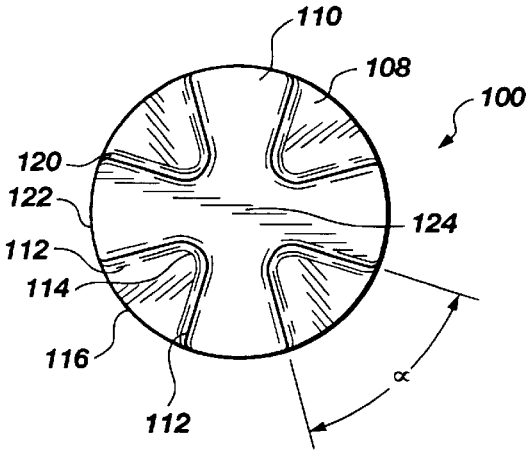
Figure 3C:
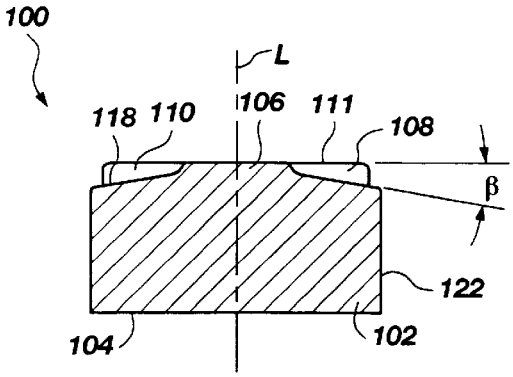

Referring to FIGS. 3A–3C and 4, a first embodiment 100 of the cutting element of the present invention will be described. Cutting element 100 includes substrate 102 in the shape of a preformed, longitudinally truncated cylinder fabricated of sintered or cemented WC or other suitable material, as known in the art. The trailing face 104 of substrate 102 as shown is flat, while the leading face 106 carrying superabrasive table 130 (see FIG. 4) is non-planar, comprising a plurality of substantially triangular indentations 108 at 90° intervals, the indentations 108 being separated by ridges 110 which converge at the center 124 of the substrate 102, the top surfaces 111 of the ridges 110 lying substantially on the same plane transverse to the longitudinal axis L of cutting element 100 so as to exhibit a "cross" shape to the viewer. The substantially triangular indentations 108 may be characterized as isosceles in general character, and are each bounded by two linear sides 112 defining about a 60° angle α therebetween, a short inner arcuate boundary 114 connecting converging linear sides 112, and an outer arcuate edge or base 116 extending between sides 112 and coincident with the outer periphery or side 122 of the substrate 102 in a finished cutting element 100. The transitions, as at 120, from the floors 118 of the indentations 108 to sides 112 and boundary 114 and from sides 112 and boundary 114 to ridge top surfaces 111 are preferably radiused rather than sharply angled, for example, along about a 0.02 inch radius. As shown, indentation floors 118 are relatively flat, angled or tilted along a radius of substrate 102 at about a 10° angle of inclination β to ridge top surfaces 111 of the ridges 110, and located so that a line extending from each floor 118 toward center 124 would intersect a line parallel to the ridge top surfaces 111 and about 0.010 inch therebelow (i.e., within substrate 102) at about a 0.060 inch radial distance from center 124, so as to provide a decrease in thickness of the indentations 108 as they extend from the side 122 of the substrate 102 toward the center 124 thereof.

Figure 4:
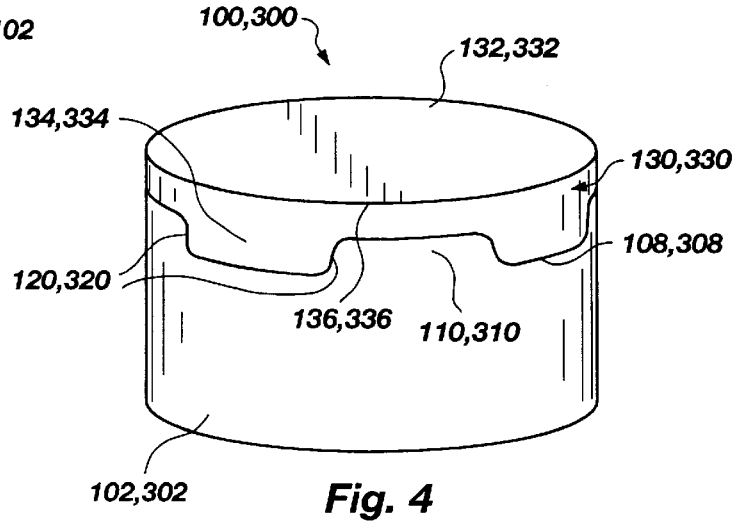
FIG. 4 comprises a perspective view of a cutting element of the first embodiment of the invention.

As can be seen in FIG. 4, superabrasive table 130, preferably comprised of a PDC, is formed on leading face 106 of substrate 102 as known in the art. Table 130 exhibits a substantially planar imperforate cutting face 132, and superabrasive projections 134 fill indentations 108 of substrate 102. The depth of superabrasive table 130 at projections 134 may be, for example, about 0.080 inch at the cutting edge 136. The remainder of table 130, other than projections 134 and substantially comprising the table area lying over the "cross" of ridges 110, and center 124 of substrate 102, comprises portions of lesser and substantially constant superabrasive thickness, for example, about 0.040 inch. Further, the surface of cutting face 132 preferably exhibits a high degree of smoothness, as disclosed and claimed in U.S. Pat. Nos. 5,447,208 and 5,653,300 to Lund et al., assigned to the assignee of the present invention. It is preferred that at least a portion of the cutting face surfaces of all of the embodiments of the invention exhibit a high degree of smoothness as taught by the Lund et al. patents.

Figure 9:
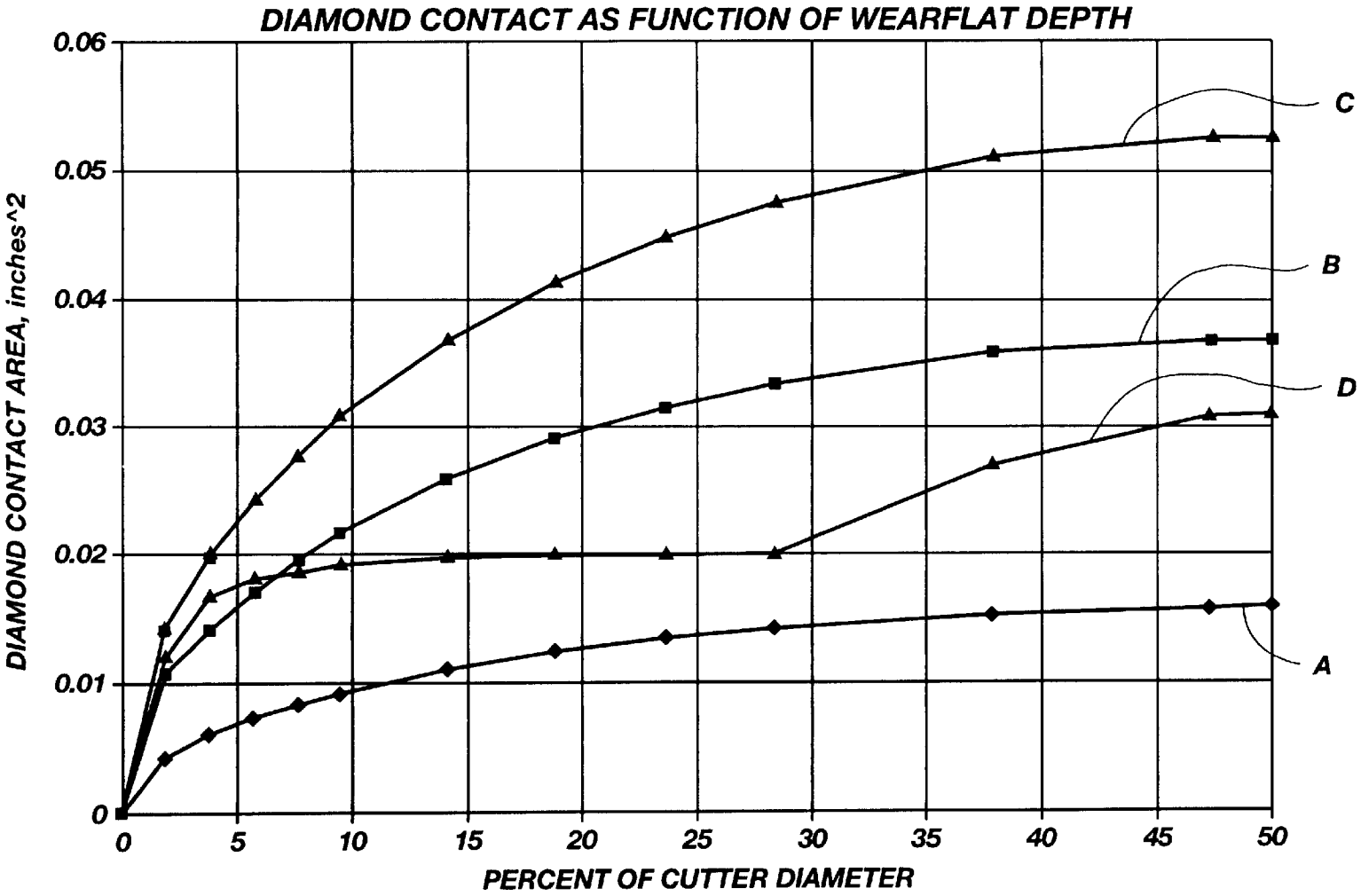
FIG. 9 comprises a graph of superabrasive wear flat area as a function of percent of circular superabrasive table diametrical wear.

In use, cutting element 100 is preferably placed with one of the substrate indentations 108 and its associated superabrasive material projection 134 oriented away from the face of the bit on which cutting element 100 is mounted, and toward the formation to be cut by cutting element 100 in a shearing-type cutting action. Such an orientation ensures, after an initial rapid increase in superabrasive contact area as an initial contact point at cutting edge 136 of table 130 wears laterally into a flat during the first 5% or less of diametric cutting face wear, that further lateral increases in the wear flat will be substantially offset by decreases in depth and width of the projection 134 until the cutting face is diametrically worn in excess of about 30%. Thus, as shown by line D in FIG. 9, the superabrasive contact area for the cutting element embodiment 100 in question will, for a 13 mm diameter cutting element, only increase from about 0.018 square inch to about 0.021 square inch as cutting element 100 wears through the aforementioned range, and to only about 0.028 square inch by the time the cutting face is 40% diametrically worn, a point well past its typical useful life.

Referring now to FIGS. 5A–5E, a first variant cutting element 200 of the first embodiment is depicted. Cutting element 200 includes a substrate 202 having indentations 208 lying between radially-extending ridges 210 disposed at 90° circumferential intervals, as with cutting element 100. However, unlike cutting element 100, ridges 210 are defined by sloping side surfaces 212 (see FIGS. 5A and 5D), which extend downward on each side of a ridge 210 from ridge top 214 to meet floors 218 of laterally adjacent indentations 208. In this variant 200, the indentation floors 218 lie substantially parallel to the plane of the cutting face 232 and transverse to the longitudinal axis of cutting element 200, rather than sloping as in cutting element 100. Further, unlike in cutting element 100, the sides of the ridges 210 are substantially parallel and the ridges 210 remain of substantially constant transverse cross section until meeting adjacent ridges 210 toward the center 224 of substrate 202, rather than the ridges necking down as they approach the center. The thickness T1 of superabrasive table 230 at projections 234 of superabrasive table 230 lying over the indentation floors 218 is about 0.080 inch, while the table thickness T2 over the tops 214 of the ridges 210 is about 0.040 inch. In variant 200, the superabrasive contact area is maintained relatively constant during wear of the cutting element by appropriate selection of the relative thicknesses of the table portions over the floors 218 and ridge tops 214, the degree to which indentations 208 decrease in width as cutting element 200 wears, and the angles of the side slopes of the ridge side surfaces 212 extending between ridge tops 214 and indentation floors 218.

Figure 5B:
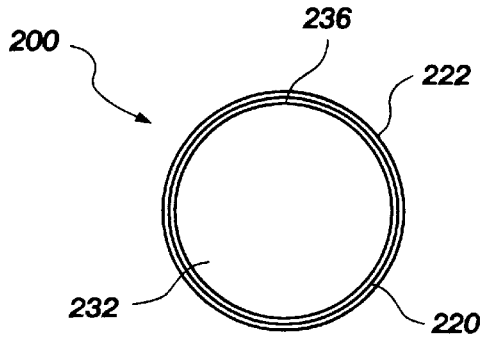
FIGS. 5A, 5B and 5C comprise, respectively, side, frontal and perspective views of one variant of the first embodiment.
Figure 5A:
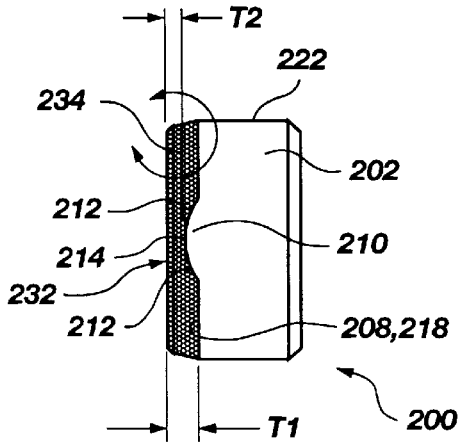
Figure 5C:
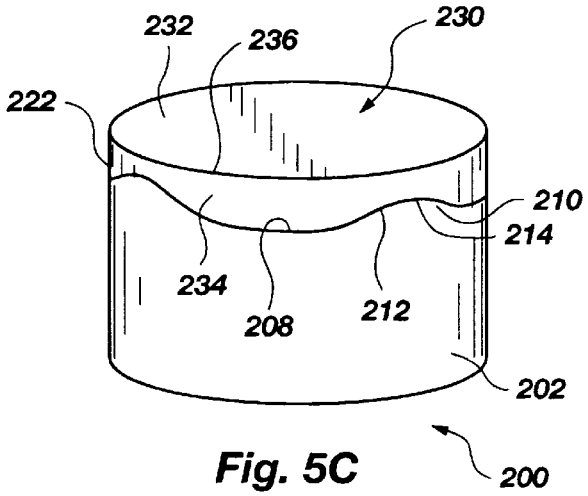
Figure 5D:
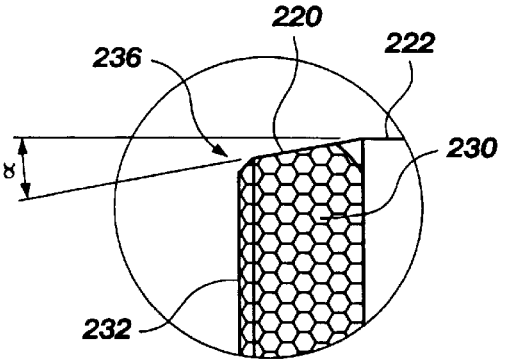
FIG. 5D is an enlarged side view of the cutting edge area of the superabrasive table.
Figure 5E:
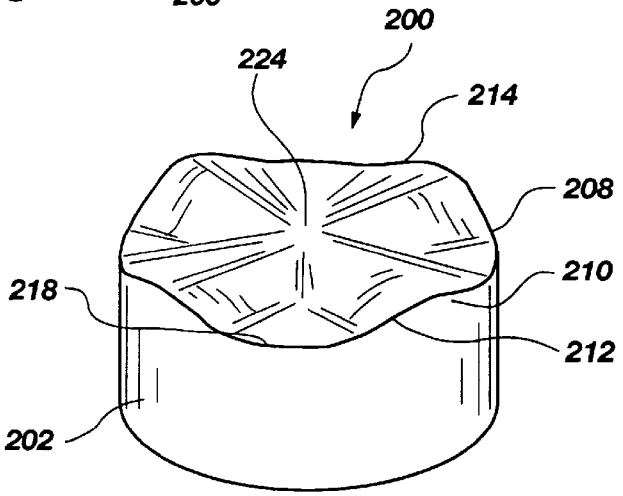
FIG. 5E is a perspective view of the leading face of a substrate for that variant.

Further, in cutting element 200, the cutting edge 236 is chamfered to about a 0.015 inch radial width at a 45° angle to the cutting face 232, and (as shown in FIG. 5A) at least part of the side of the table 230 may be angled at about a 10° angle γ to the side 222 of the substrate 202 as taught by U.S. Pat. No. 5,437,343 to Cooley et al, assigned to the assignee of the present invention. Alternatively, as shown in FIG. 5C, a chamfer and an angled table side may be eliminated, as desired.

Figure 6A:
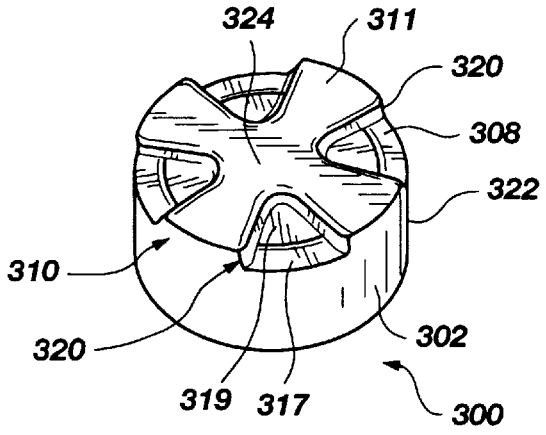
FIGS. 6A, 6B and 6C comprise, respectively, perspective, frontal and side sectional views of a substrate for another variant of the first embodiment.
Figure 6B:
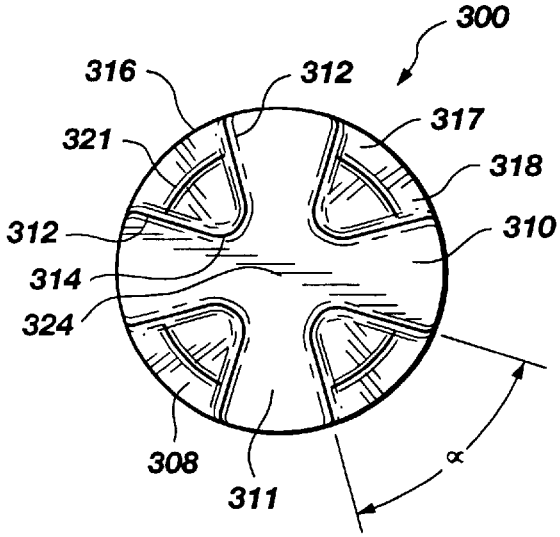
Figure 6C:
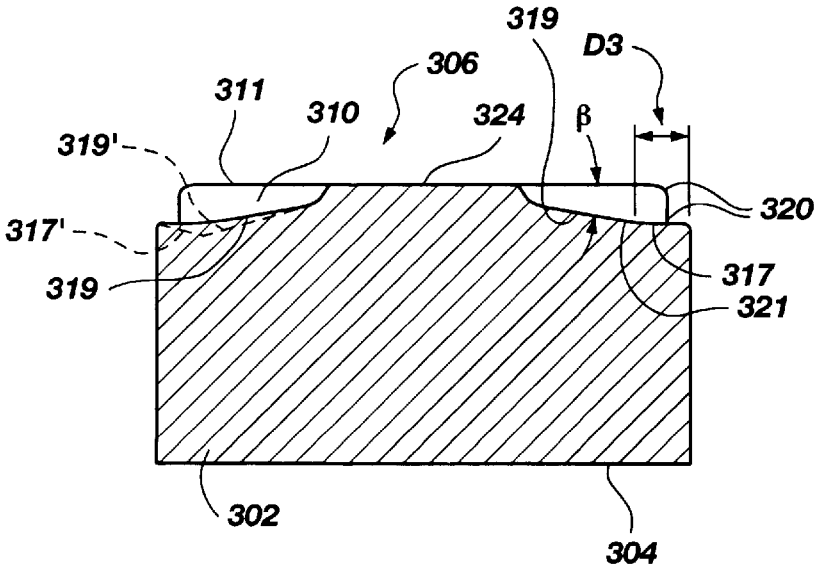

FIGS. 6A through 6C depict a substrate 302 for another variant 300 of the first embodiment of the cutting element of the invention. Substrate 302 is similar to substrate 102, except that leading face 306 includes substantially isosceles triangular indentations 308 having composite topography floors 318, each comprising an outer, arcuate, flat shelf 317 oriented substantially parallel to the ridge top surfaces 311 of ridges 310, shelf 317 extending radially inwardly a measurable distance D3 (for example, about 0.030 inch) to an inner, substantially flat surface 319. Surface 319 may actually be characterized as a very shallow, barely perceptible concavity comprising a section of a cone of revolution. Surface 319 is inclined along a radius of substrate 302 at an angle β, for example, about 10° for a 0.529 inch or 13 mm diameter cutting element, to the ridge top surfaces 311 of ridges 310 and located to intersect a line parallel to and 0.010 inch below ridge tops 311 about 0.060 inch radially outward of center 324, so as to reduce the depth of the indentation 308 as the radial distance from the center 324 of the substrate 302 decreases. Composite topography floors 318 are bounded by a pair of linear, convergently-oriented sides 312 of adjacent ridges 310 (again defining about a 60° included angle) connected at their radially inner ends by arcuate boundary 314 and at their radially outer ends by outer arcuate base or edge 316 extending therebetween and substantially coincident with the outer periphery or side 322 of substrate 302 in a finished cutting element 300. The boundary 321 between shelf 317 and inner, flat surface 319 is preferably arcuate or radiused, rather than sharp, for example, on about a 0.125 inch radius. The exterior of a cutting element formed with substrate 302 would look substantially identical to cutting element 100 (see FIG. 4), and so is not separately illustrated, although reference numerals applicable to cutting element 300 are shown in FIG. 4 for clarity. The transitions as at 320 between the outer periphery of shelf 317 and surface 319 and sides 312 and boundary 314 and between sides 312 and boundary 314 and ridge tops 311 are radiused, as with substrate 302. The presence of shelf 317 at the outer periphery of each indentation 308 provides a larger depth of superabrasive material (see FIG. 4) in projections 334 of superabrasive table 330 at the cutting edge 336 to sustain initial impacts with the formation until a wear flat is formed, and thus may form a more robust cutting element. It is also contemplated (see FIG. 6C) that shelf 317 may even dip downward as it extends radially inward from the side 322 of substrate 302, as shown in broken lines 317', to provide an even greater effective thickness of superabrasive table 330 in a projection 334 oriented toward the formation and aligned with the resultant force acting on the cutting edge of the imperforate cutting face 332 and, further, that the angle of inclination β of surface 319 may be greater than 10° (again, as shown in broken lines 319') to accommodate this configuration of shelf 317.

Figure 7A:
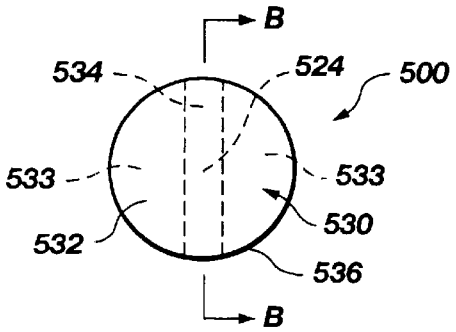
FIGS. 7A and 7B comprise, respectively, frontal and side sectional views of a second embodiment of the invention.
Figure 7B:
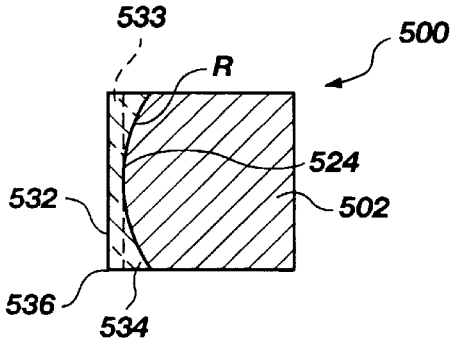

FIGS. 7A and 7B depict a second embodiment 500 of the cutting element of the present invention. Cutting element 500 includes a substrate 502 onto which is formed a superabrasive table 530. Table 530 includes at least one radial or diametric projection 534 of substantially constant widths and of increased thickness with respect to the remainder of table 530. Projection 534 is thickest adjacent cutting edge 536, and decreases in thickness non-linearly (such as along a radius of curvature R) as it approaches the center 524 of substrate 502. Thus, as cutting face 532 and table 530 wears toward center 524 during use, the decreasing thickness of projection 534 is offset by the increase in superabrasive contact area with the formation afforded by the increasing width of the thinner table areas 533 flanking projection 534.

Figure 8A:
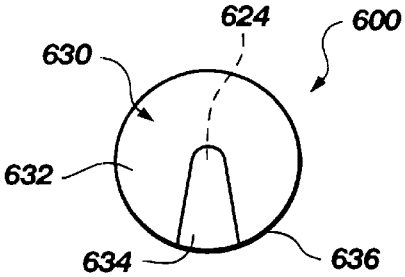
FIGS. 8A and 8B comprise, respectively, frontal and side views of a third embodiment of the invention.
Figure 8B:
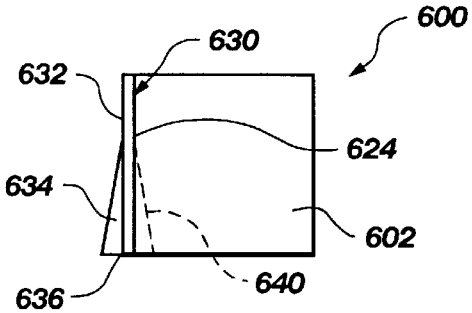

FIGS. 8A and 8B depict a third embodiment 600 of the cutting element of the present invention. Cutting element 600 includes a substrate 602 onto which a superabrasive table 630 is formed, there being a substantially planar interface or boundary between the two elements. Table 630 includes a radial projection 634 protruding from the cutting face 632, projection 634 decreasing in both depth and width toward the center 624 of substrate 602 so that the superabrasive contact area with the formation remains substantially constant as cutting edge 636 wears into a flat during drilling and the increase in the lateral width of the wear flat is offset by the decrease in the footprint size of the projection 634. Optionally, as shown in broken lines 640, projection 634 may extend from the rear of table 630 as well as, or in lieu of, from cutting face 632.

Figure 10A:
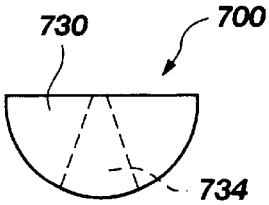
FIGS. 10A, 10B and 10C depict, respectively, additional cutting element embodiments of the invention exhibiting arcuate cutting edges and other than circular cutting faces.
Figure 10B:
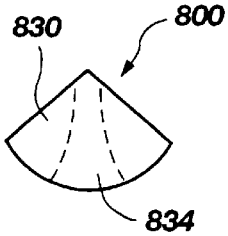
Figure 10C:
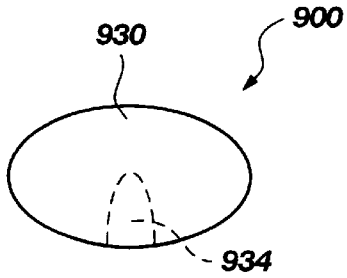

FIGS. 10A, 10B and 10C respectively depict cutting elements exhibiting arcuate cutting edges and other than circular superabrasive tables and cutting faces. Cutting element 700 of FIG. 10A is of half-cylindrical configuration, with half-circular superabrasive table 730, projection 734 extending to the rear thereof into the supporting substrate. Cutting element 800 of FIG. 10B is of one-third cylindrical configuration, with one-third circular superabrasive table 830, projection 834 extending to the rear thereof into the supporting substrate. Cutting element 900 of FIG. 10C is of ellipsoidal configuration, with ellipsoidal superabrasive table 930, projection 934 extending to the rear thereof into the supporting substrate.

Figure 11:
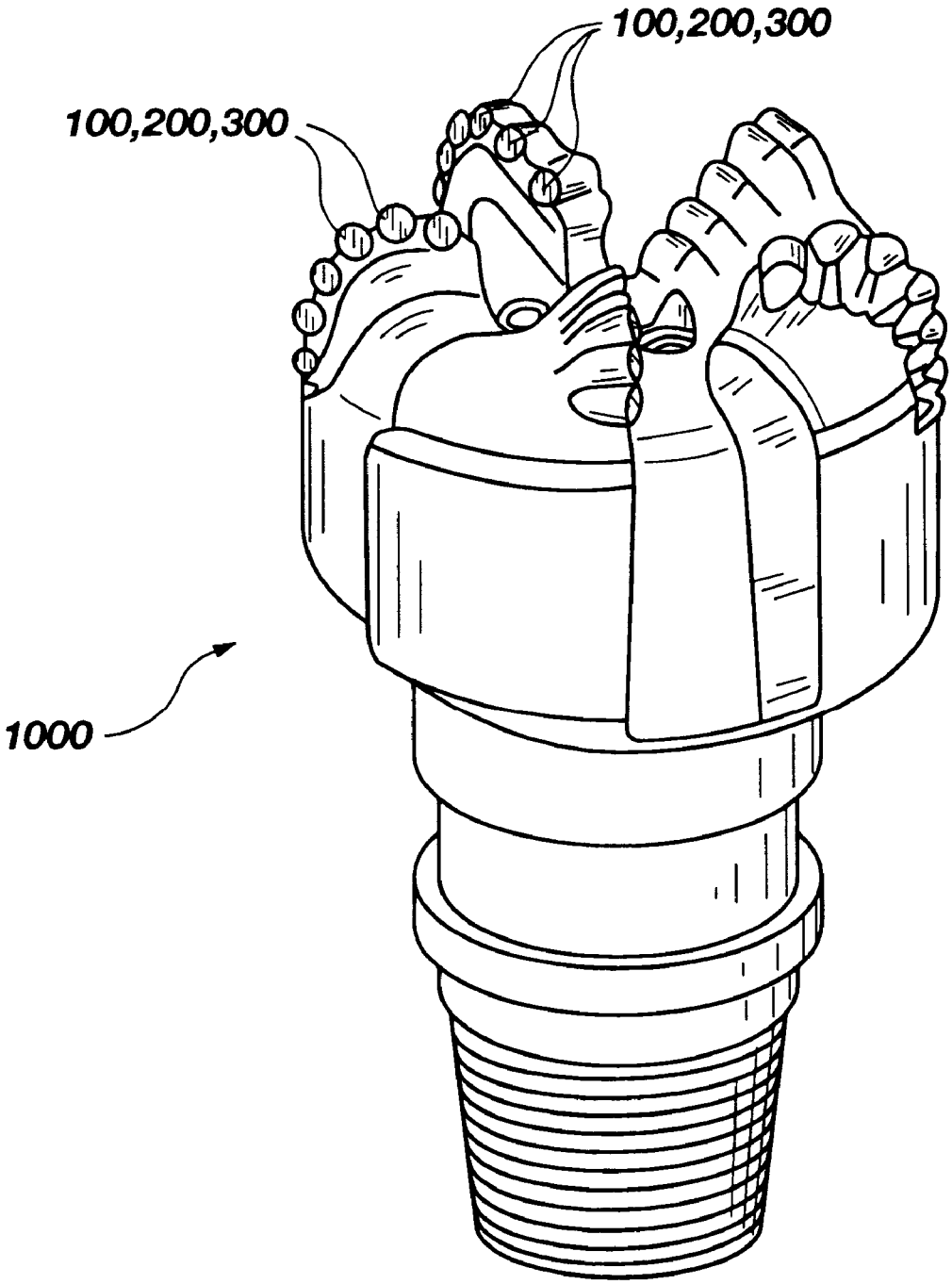
FIG. 11 depicts a rotary drag bit having cutting elements according to the invention mounted thereto.

FIG. 11 depicts a drill bit in the form of a rotary drag bit 1000 having cutting elements 100, 200 and 300 mounted thereon in accordance with the present invention.

As noted previously, the cutting elements of the present invention may employ any known superabrasives, including without limitation, PDCs, thermally stable PDCs, diamond films, and cubic boron nitride compacts. It is contemplated that superabrasive tables according to the invention may be formed as free-standing superabrasive masses and employed as cutting elements secured directly to the bit face as by brazing or during infiltration of a matrix-type bit, in addition to being formed onto supporting substrates as is conventional in PDC fabrication. Substrates may take the form of cylinders or studs, as desired, the manner of securement of the cutting elements to the bit face being of no consequence to the invention.

It will be appreciated by those of ordinary skill in the art that the cutting elements of the invention permit maintenance of WOB for a given ROP (or range of ROPs) within a controlled, non-disadvantageous magnitude through control of the superabrasive contact area of the cutting elements on the bit with a formation being drilled. Thus, the present invention includes novel and unobvious methods of drilling.

While the cutting elements and drill bits of the present invention have been described in terms of certain illustrated embodiments, those of ordinary skill in the art will understand and appreciate that it is not so limited. Rather, additions, deletions and modifications to the illustrated embodiments may be effected, as well as combinations of features of different embodiments, without departing from the scope of the invention as set forth hereinafter in the claims.

What is claimed is:

1. A cutting element for use on a drill bit for drilling a subterranean formation, comprising:

a superabrasive table having an imperforate cutting face extending in two dimensions and to be oriented on said drill bit generally transverse to an intended direction of cutting element travel under rotation of said drill bit, said superabrasive table exhibiting an arcuate, peripheral cutting edge between said imperforate cutting face and a side portion of said superabrasive table; and wherein said superabrasive table includes at least one integral, superabrasive projection comprising a substantially triangular shape extending transverse to said imperforate cutting face between a location adjacent said cutting edge and a location adjacent an inner region of said superabrasive table, said at least one integral, superabrasive projection being laterally bounded by two substantially linear side surfaces converging toward said inner region, an arcuate inner boundary surface adjacent said inner region and connecting inner ends of said two substantially linear side surfaces, and a peripherally outer, arcuate base.

2. The cutting element of claim 1, wherein said superabrasive table is, when said cutting element is oriented on said drill bit with said at least one integral, superabrasive projection facing said subterranean formation, configured to provide a substantially constant superabrasive contact area with said subterranean formation at said arcuate peripheral cutting edge of said superabrasive table after said arcuate, periphal cutting edge has worn to a substantially linear edge during said drilling and for a substantial additional portion of subsequent superabrasive table side wear thereafter.

3. The cutting element of claim 2, wherein said substantially constant superabrasive contact area includes a slightly increasing contact area after formation of said substantially linear edge.

4. The cutting element of claim 1, wherein said substantially constant superabrasive contact area is provided at between about five percent and about thirty percent wear of said imperforate cutting face, measured in a direction of wear of said superabrasive table during said drilling.

5. The cutting element of claim 4, wherein said substantially constant superabrasive contact area includes a slightly increasing contact area after formation of said substantially linear edge.

6. The cutting element of claim 1, wherein said at least one integral, superabrasive projection is of substantially rectangular cross section, taken transverse to a line between said superabrasive table side portion and said inner region of said superabrasive table.

7. The cutting element of claim 1, wherein said at least one integral, superabrasive projection abruptly laterally extends, along at least a portion of its length, to a lesser thickness portion of said superabrasive table.

8. The cutting element of claim 1, wherein said at least one integral, superabrasive projection extends substantially to a center region of said superabrasive table.

9. The cutting element of claim 1, wherein said at least one integral, superabrasive projection exhibits a substantially constant thickness for a measurable radial distance inward from said arcuate, peripheral cutting edge.

10. The cutting element of claim 1, wherein said at least one integral, superabrasive projection exhibits an increasing thickness for a measurable radial distance inward from said arcuate, peripheral cutting edge.

11. The cutting element of claim 1, further including a supporting substrate adjacent a face of said superabrasive table opposite said imperforate cutting face.

12. The cutting element of claim 11, wherein said at least one itegral, superabrasive projection extends into a like-shaped indentation in said supporting substrate.

13. The cutting element of claim 1, wherein said at least one integral, superabrasive projection protrudes from said imperforate cutting face.

14. The cutting element of claim 13, wherein said at least one integral, superabrasive projection also protrudes from said superabrasive table behind said imperforate cutting face.

15. The cutting element of claim 1, wherein said at least one integral, suprabrasive projection protrudes from said superabrasive table behind said imperforate cutting face.

16. The cutting element of claim 1, wherein said substantially triangular shape comprises a substantially isosceles triangular shape.

17. The cutting element of claim 1, wherein said at least one integral, superabrasive projection decreases in thickness between said peripherally outer, arcuate base and said inner boundary.

18. The cutting element of claim 1, wherein said two substantially linear side surfaces and said inner boundary surface laterally bounding said at least one integral, superabrasive projection are oriented oblique to said cutting face.

19. A cutting element for use on a drill bit for drilling a subterranean formation, comprising:

a superabrasive table having a cutting face extending generally in a two-dimensional plane and to be oriented on said drill bit generally transverse to an intended direction of cutting element travel, said superabrasive table exhibiting an arcuate, peripheral cutting edge between said cutting face and a side portion of said superabrasive table; and a supporting substrate having an end adjacent a face of said superabrasive table opposite said cutting face, a side portion substantially coincident with said side portion of said superabrasive table and including a plurality of indentations on said end located between a like plurality of substantially radially-extending ridges, each ridge of said plurality of substantially radially-extending ridges extending from said side portion of said supporting substrate to a mutually proximate location in an inner portion of said superabrasive table, said plurality of substantially radially-extending ridges each being of substantially constant transverse cross section and defined by downwardly sloping side surfaces extending to floors of said plurality indentations;

said superabrasive table extending over said supporting substrate end, including a plurality of superabrasive projections integral therewith and extending transverse to the two-dimensional plane of said cutting face into said plurality of indentations on said supporting substrate end.

20. The cutting element of claim 19, wherein said superabrasive projections decrease in at least one of width and depth between a location adjacent said peripheral cutting edge and said location adjacent said superabrasive table inner portion.

21. The cutting element of claim 20, wherein said decrease in said at least one of projection width and depth is substantially linear over at least a portion of projection length between said peripheral cutting edge-adjacent location and said superabrasive table inner portion adjacent location.

22. The cutting element of claim 19, wherein said projections are each of substantially triangular shape.

23. The cutting element of claim 22, wherein said substantially triangular shape comprises a substantially isosceles triangular shape.

24. The cutting element of claim 19, wherein said plurality of superabrasive projections gradually laterally extend, along at least a portion of their respective extents between said superabrasive table side portion and said inner portion of said superabrasive table, to a lesser thickness portion of said superabrasive table.

25. A cutting element for drilling a subterranean formation, comprising:

a substantially circular superabrasive table having an imperforate cutting face and an opposing rear face extending in two dimensions generally transverse to an intended direction of cutting element travel, a side between said imperforate cutting face and said opposing rear face, and a cutting edge defined between said imperforate cutting face and said side along a peripheral portion of said substantially circular superabrasive table;

said superabrasive table further including a plurality of integral, circumferentially-spaced projections extending transversely from at least one face of said superabrasive table, each of said projections of said plurality of integral, circumferentially-spaced projections extending substantially radially inwardly from a location adjacent said side to a location closer to a center of said superabrasive table and comprising a substantially triangular shape laterally bounded by two substantially linear side surfaces converging toward said center of said superabrasive table, an arcuate inner boundary surface connecting inner ends of said two substantially linear side surfaces, and a peripherally outer, arcuate base.

26. The cutting element of claim 25, wherein said projections decrease in thickness between said locations adjacent said superabrasive table side and said locations adjacent said superabrasive table center.

27. The cutting element of claim 26, wherein said decrease in projection thickness is substantially linear over at least a portion of said substantial radial inward projection extension.

28. The cutting element of claim 25, wherein said projections are of substantially rectangular cross section, taken transverse to a radial line extending between said peripheral portion of said superabrasive table and said superabrasive table center.

29. The cutting element of claim 25, wherein said projections gradually laterally extend, along at least a portion of their lengths, to a lesser thickness portion of said superabrasive table.

30. The cutting element of claim 25, wherein said projections each substantially abruptly laterally extend, along at least a portion of their respective substantially radial inward extents, to a lesser thickness portion of said superabrasive table.

31. The cutting element of claim 25, wherein at least some of said plurality of integral-circumferentially-spaced projections exhibit a substantially constant thickness for a measurable radial distance inward from said side.

32. The cutting element of claim 25, wherein at least some of said projections exhibit an increasing thickness for a measurable radial distance inward from said side.

33. The cutting element of claim 25, further including a supporting substrate adjacent said rear face of said superabrasive table.

34. The cutting element of claim 33, wherein said projections extend into like-shaped indentations in said supporting substrate.

35. The cutting element of claim 25, wherein said projections protrude from said cutting face.

36. The cutting element of claim 35, wherein said projections also protrude from said rear face.

37. The cutting element of claim 25, wherein said projections protrude from said rear face.

38. The cutting element of claim 25, wherein said substantially triangular shape comprises a substantially isosceles triangular shape.

39. The cutting element of claim 25, wherein said two substantially linear side surfaces and said arcuate inner boundary surface laterally bounding said plurality of integral, circumferentially-spaced projections are oriented oblique to said imperforate cutting face.

40. A rotary drag bit for drilling a subterranean formation, comprising:

a bit body having at least one cutting element mounted thereon, said at least one cutting element comprising:

a substantially circular superabrasive table having an imperforate cutting face and an opposing rear face extending in two dimensions generally transverse to an intended direction of cutting element travel, a side between said imperforate cutting face and said opposing rear face, and a cutting edge defined between said imperforate cutting face and said side along a peripheral portion of said superabrasive table;

said superabrasive table further including a plurality of circumferentially-spaced projections extending transversely from at least one face of said superabrasive table, said projections each extending substantially radially inwardly from a location adjacent said side to a location closer to a center of said superabrasive table and comprising a substantially triangular shape laterally bounded by two substantially linear side surfaces converging toward said center of said superabrasive table, an arcuate inner boundary surface connecting inner ends of said two substantially linear side surfaces, and a peripherally outer, arcuate base.

41. The rotary drag bit of claim 40, wherein said projections decrease in thickness between said locations adjacent said superabrasive table side and said locations adjacent said superabrasive table center.

42. The rotary drag bit of claim 41, wherein said decrease in thickness is substantially linear over at least a portion of said substantial radial inward projection extension.

43. The rotary drag bit of claim 40, wherein said projections are of substantially rectangular cross section, taken transverse to a radial line extending between said peripheral portion of said superabrasive table and said superabrasive table center.

44. The rotary drag bit of claim 40, wherein said projections gradually laterally extend, along at least a portion of their respective extents between said superabrasive table side and said superabrasive table center, to a lesser thickness portion of said superabrasive table.

45. The rotary drag bit of claim 40, wherein said projections substantially abruptly laterally extend, along at least a portion of their lengths, to a lesser thickness portion of said superabrasive table.

46. The rotary drag bit of claim 40, wherein at least some of said plurality of circumferentially-spaced projections meet at said superabrasive table center.

47. The rotary drag bit of claim 40, wherein at least some of said plurality of circumferentially-spaced projections exhibit a substantially constant thickness for a measurable radial distance inward from said side.

48. The rotary drag bit of claim 40, wherein at least some of said plurality of circumferentially-spaced projections exhibit an increasing thickness for a measurable radial distance inward from said side.

49. The rotary drag bit of claim 40, further including a supporting substrate adjacent said opposing rear face of said superabrasive table, said at least one cutting element being secured to said bit body substantially through said supporting substrate.

50. The rotary drag bit of claim 49, wherein said projections extend into like-shaped indentations in said supporting substrate.

51. The rotary drag bit of claim 40, wherein at least some of said plurality of circumferentially-spaced projections protrude from said cutting face.

52. The rotary imperforate drag bit of claim 51, wherein at least some of said plurality of circumferentially-spaced projections protrude from said opposing rear face.

53. The rotary drag bit of claim 40, wherein at least some of said plurality of circumferentially-spaced projections protrude from said opposing rear face.

54. The rotary drag bit of claim 40, wherein said substantially triangular shape comprises a substantially isosceles triangular shape.

55. The rotary drag bit of claim 40, wherein said two substantially linear side surfaces and said arcuate inner boundary surface laterally bounding each of said plurality of circumferentially-spaced projections are oriented oblique to said imperforate cutting face.

56. A rotary drag bit for drilling a subterranean formation, comprising:

a bit body;

at least one cutting element mounted on said bit body and comprising:

a substantially circular superabrasive table having a cutting face and an opposing rear face extending in two dimensions generally transverse to an intended direction of cutting element travel, a side between said cutting face and said rear face, and a cutting edge defined between said cutting face and said side along a peripheral portion of said substantially circular superabrasive table; and a supporting substrate having an end adjacent a face of said superabrasive table opposite said cutting face, a side portion substantially coincident with said side along a peripheral portion of said superabrasive table and including a plurality of indentations on said end located between a like plurality of substantially radially-extending ridges, each ridge of the plurality of substantially radially extending ridges extending from said side portion of said suporting substrate to a location adjacent a center of said superabrasive table, said plurality of substantially radially-extending ridges each being of substantially constant transverse cross section and defined by downwardly sloping side surfaces extending to floors of said plurality of indentations;

said superabrasive table extending over said supporting substrate end, including a plurality of superabrasive projections integral therewith and extending transverse to a plane of said cutting face into said plurality of indentations on said supporting substrate end.

57. The rotary drag bit of claim 56, wherein said superabrasive projections decrease in at least one of width and depth between said locations adjacent said superabrasive table side and said locations adjacent said superabrasive table center.

58. The rotary drag bit of claim 57, wherein said decreases in superabrasive projection width and depth are substantially linear over at least a portion of an extent of a projection between said superabrasive table side and said superabrasive table center.

59. The rotary drag bit of claim 56, wherein said superabrasive projections are of substantially rectangular cross section, taken transverse to a direction of elongation.

60. The rotary drag bit of claim 56, wherein said superabrasive projections are of substantially triangular shape.

61. The rotary drag bit of claim 60, wherein said substantially triangular shape comprises a substantially isosceles triangular shape.

62. The rotary drag bit of claim 56, wherein said superabrasive projections gradually laterally extend, along at least a portion of their respective extents between said superabrasive table side and said superabrasive table center, to a lesser depth portion of said superabrasive table.

63. The rotary drag bit of claim 56, wherein said superabrasive projections substantially abruptly laterally extend, along at least a portion of their lengths, to a lesser depth portion of said superabrasive table.

64. The rotary drag bit of claim 56, wherein at least some of said plurality of superabrasive projections meet at said superabrasive table center.

65. The rotary drag bit of claim 56, wherein at least some of said superabrasive projections exhibit a substantially constant depth for a measurable radial distance inward from said side.

66. The rotary drag bit of claim 56, wherein at least some of said superabrasive projections exhibit an increasing depth for a measurable radial distance inward from said side.

67. The rotary drag bit of claim 56, wherein at least some of said superabrasive projections also protrude from said cutting face.

* * * * *

UNITED STATES PATENT AND TRADEMARK OFFICE

CERTIFICATE OF CORRECTION

PATENT NO. : 6,202,771 B1
DATED : March 20, 2001
INVENTOR(S) : Danny E. Scott et al.

It is certified that error appears in the above-identified patent and that said Letters Patent is hereby corrected as shown below:

Title page,
Item [57], ABSTRACT,
Line 9, delete the comma after “configured”
Line 10, delete the comma after “both”
Line 13, delete the comma after “wears”

Column 1,
Line 9, delete the comma after “drilling” and insert a comma after “and”
Line 10, insert a comma after “specifically”

Column 2,
Line 42, before “contact” insert -- the --
Line 50, delete the comma after “face”
Line 51, insert a comma after “above”
Line 55, change “a segment or” to -- or a segment --

Column 5,
Line 8, delete the comma after “character”

Column 6,
Line 56, change “tops” to -- top surfaces --

Column 8,
Line 47, after “said” and before “cutting” insert -- arcuate, peripheral --

Column 9,
Line 34, change “itegral” to -- integral --
Line 56, after “said” and before “cutting” insert -- imperforate --

Column 10,
Line 12, after “plurality” and before “indentations” insert -- of --
Line 19, after “said” insert -- plurality of --

Column 12,
Line 49, after “said” and before “cutting” insert -- imperforate --

UNITED STATES PATENT AND TRADEMARK OFFICE

CERTIFICATE OF CORRECTION

PATENT NO. : 6,202,771 B1
DATED : March 20, 2001
INVENTOR(S) : Danny E. Scott et al.

It is certified that error appears in the above-identified patent and that said Letters Patent is hereby corrected as shown below:

Column 13,
Line 5, after "said" and before "rear" insert -- opposing --

Signed and Sealed this

First Day of February, 2005

JON W. DUDAS
*Director of the United States Patent and Trademark Office*